US005469822A

United States Patent [19]

Mechsner

[11] Patent Number: 5,469,822

[45] Date of Patent: Nov. 28, 1995

[54] OIL PAN FOR COMBUSTION MACHINES AND METHOD OF MAKING THE OIL PAN

[75] Inventor: Klaus Mechsner, Neuwied, Germany

[73] Assignee: VAW Aluminium AG, Bonn, Germany

[21] Appl. No.: 306,646

[22] Filed: Sep. 15, 1994

[30] Foreign Application Priority Data

Oct. 13, 1993 [DE] Germany ..... 43 34 858.3

[51] Int. Cl.[6] ..... F02F 7/00

[52] U.S. Cl. ..... 123/195 C; 184/106; 123/195 H

[58] Field of Search ..... 123/195 C, 195 H; 184/106; 29/888.01

[56] References Cited

U.S. PATENT DOCUMENTS 4,876,998 10/1989 Wünsche ..... 123/195 H 4,911,118 3/1990 Kageyama et al. ..... 123/195 H

*Primary Examiner*—Noah P. Kamen

*Attorney, Agent, or Firm*—Darby & Darby

[57] ABSTRACT

An oil pan for a combustion engine includes two extrusions which are welded to one another so as to form an elongated chamber. The ends of the chamber are closed by covers. At least two partitions are disposed one above the other inside the chamber. The partitions extend transversely of the chamber and are carried by holders provided on the internal surfaces of the extrusions. Each of the partitions has an oil deflecting portion as well as two flat projections which protrude to opposite sides of the respective oil deflecting portion and serve to connect the partitions to the holders. The projections of each partition define a horizontal support plane for the respective partition while the oil deflecting portions define vertical surfaces for damping oil surges.

28 Claims, 2 Drawing Sheets

FIG. 1
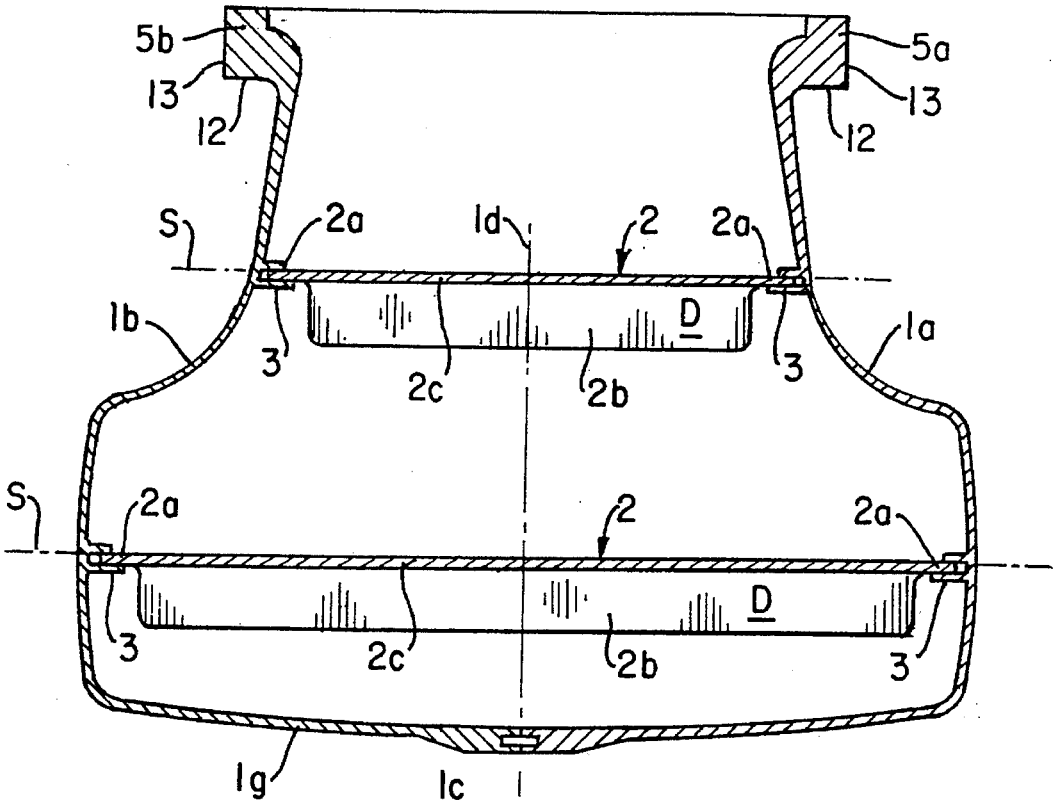
FIG. 2a
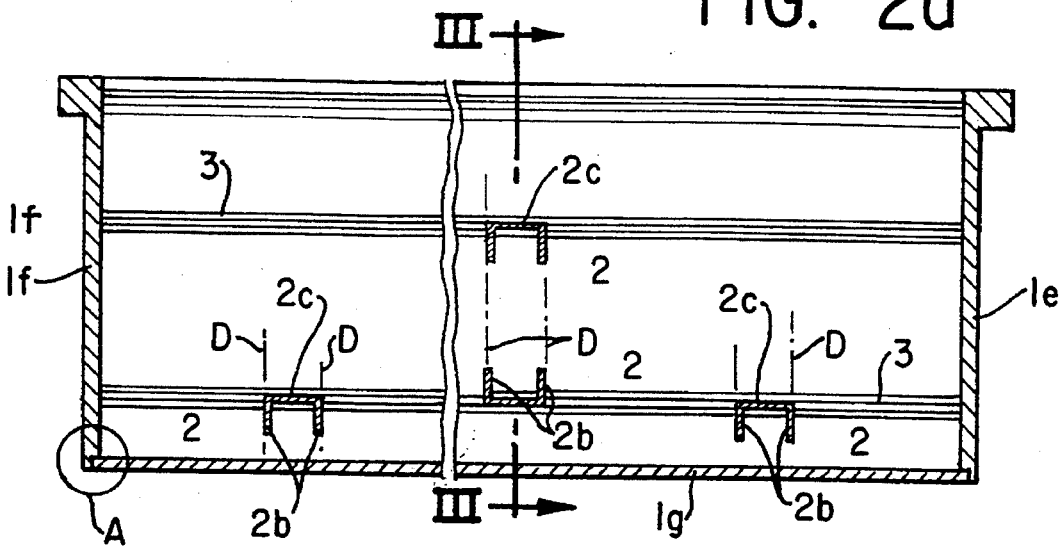
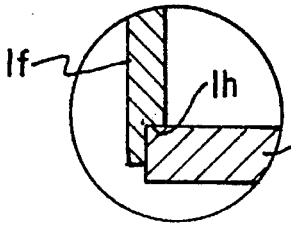
FIG. 2b

OIL PAN FOR COMBUSTION MACHINES AND METHOD OF MAKING THE OIL PAN

FIELD OF THE INVENTION

The invention relates to combustion machines.

BACKGROUND OF THE INVENTION

A conventional oil pan for combustion machines is composed of a plurality of sheet metal components which are welded to one another. Since a large number of welds is required, it has been proposed to use extrusions for the oil pan. This allows the number of components to be reduced and makes it possible to decrease the weight and improve the dimensional accuracy of the oil pan.

A known oil pan of the type containing extrusions is provided with flanges for connecting the oil pan to a crankcase. Covers are arranged at the ends of the oil pan and partitions are disposed internally thereof. The partitions are secured to the walls of the oil pan and extend transversely of the latter.

The development of high output engines has increased the amount of oil required for reliable lubrication and adequate heat removal. However, a large amount of oil necessitates a large oil pan volume which imposes additional requirements on the stiffness of the oil pan and its resistance to vibration.

The surges which occur with a large amount of oil also generate particularly large loads. In conjunction with the vibrations from the engine, these loads can impose undue stresses on the oil pan joints. It has been found that cracks frequently appear at the joints between the relatively stiff oil pan walls and the flexible partitions. These cracks can lead to joint failure and resulting engine damage.

SUMMARY OF THE INVENTION

It is an object of the invention to increase the strength of an oil pan.

Another object of the invention is to improve the heat removal capacity of an oil pan.

An additional object of the invention is to improve the vibration resistance of an oil pan.

A further object of the invention is to decrease the ratio of oil pan weight to oil capacity.

It is also an object of the invention to provide a method which allows an oil pan to be produced relatively simply.

Still another object of the invention is to provide a method which enables an oil pan to be made relatively economically.

Yet a further object of the invention is to provide a method which makes it possible to produce an oil pan using largely automated welding or other joining equipment.

The preceding objects, as well as others which will become apparent as the description proceeds, are achieved by the invention.

One aspect of the invention resides in an oil pan for combustion machines. The oil pan comprises wall means defining an oil chamber, and partitioning means in the chamber including at least one partition having first means for supporting the partition on the wall means and second means for deflecting oil in the chamber. The first means defines a support plane for the partition and the second means defines at least one oil deflecting plane which is substantially normal to the support plane.

The oil chamber may be elongated and the partition can then extend transversely of the chamber. The support plane is preferably arranged to be substantially horizontal.

The wall means may include a plurality of extrusions which define first walls of the oil chamber. If the configuration of the chamber is such that the chamber has opposed ends, the extrusions can extend between these ends. The wall means may here further include a cover at each of the ends, and the covers can be secured to the extrusions and define second walls of the chamber. The walls may be provided with a flange or flanges for connection to a crankcase.

The invention makes it possible, even in high-speed engines subjected to large thermal loads, to increase heat removal while reducing weight.

In accordance with one embodiment of the invention, the oil pan includes one or more longitudinally extending extrusions whereas extrusions constructed as covers are employed at the ends of the oil pan. The partition or partitions, which serve as surge protectors, may be made of extrusions or sheet material and are preferably U-shaped or Z-shaped. However, they can have other 3-dimensional forms.

An important feature of the partitions of the invention, which replace the prior art partitions, is the presence of mutually perpendicular support planes and oil deflecting planes. It is preferred for the partitions to be disposed one above the other. As noted earlier, the partitions may extend transverse to the elongation of the oil pan. However, it is also possible for the partitions to extend longitudinally and transversely of the oil pan. In the latter case, the longitudinal partitions can be mounted on the covers of the oil pan.

The walls of the oil pan may be provided with supports or mounts for the partitions. The spatial configuration of the partitions allows particularly good stiffening of the oil pan to be achieved when the supports include spacers which project from the walls of the oil pan and have partition holders disposed at a spacing from the walls. Stiffening may be enhanced by making the oil pan bottle-shaped, distributing supports over the internal periphery of the oil pan and connecting the supports to one another by means of oil deflecting partitions as well as stiffening ribs or partitions. This allows hollow compartments to be formed in the oil pan, and the hollow compartments can define a sandwich-like structure having increased stiffness in both the longitudinal and transverse directions.

Investigations have revealed that the bottom region of large oil pans oscillates like a membrane due to engine vibrations and that, depending upon the resonance characteristics of the oil pan, large cyclic stresses are generated in the joints. By designing the supports for the partitions with partition holders mounted on spacers, the oil pan of the invention is stiffened, especially in the bottom region. At the same time, a large moment of inertia is achieved and dampens the oscillations. This also has a favorable effect on the acoustical properties, and a high-output engine equipped with an oil pan according to the invention exhibits an approximately 10 percent lower noise level.

Selection of the spatial structure of the oil deflecting partitions should take into account the flow situation in the oil pan. To obtain good damping, the wave motion of the oil needs to be reduced without eddy formation or turbulence. For this reason, the cross sections are preferably symmetrical and rounded at the transitions.

It is possible to use flexible spatial structures which are adjusted to the particular flow situation. In this regard, the surge energy should be adequately reduced without unduly increasing the forces conducted into the partition supports.

The following advantages are obtained when using supports which include a partition holder mounted on a spacer:

1. The oil deflecting partitions are separated from the oil pan walls from the standpoint of vibrations.
2. Mechanical utilization of the oil deflecting partitions becomes possible.
3. When the partitions are thermally connected to their supports, the heat affected zone is remote from the oil pan walls.

The last feature, in particular, allows the extrusions constituting part of the oil pan to be relatively thin without creating problems in endurance or stress corrosion cracking.

BRIEF DESCRIPTION OF THE DRAWINGS

Additional features and advantages of the invention will become apparent from the following detailed description of preferred embodiments when read in conjunction with the accompanying drawings.

FIG. 1 is a transverse sectional view of one embodiment of an oil pan in accordance with the invention;

FIG. 2*a* is a longitudinal sectional view of another embodiment of an oil pan according to the invention and illustrates the cross section of one embodiment of a partition for the oil pan;

FIG. 2*b* is an enlarged sectional view of a detail of the oil pan of FIG. 2*a;*

DESCRIPTION OF PREFERRED EMBODIMENTS

FIG. 1 shows an oil pan for a combustion engine. The oil pan includes a pair of extrusions 1*a* and 1*b* which define respective side walls of the oil pan. The extrusions 1*a* and 1*b* are welded to one another at a junction 1*c* which lies in a central plane 1*d* of the oil pan. This arrangement results in a uniform distribution of the stresses acting on the oil pan.

The oil pan is elongated in a direction normal to the plane of FIG. 1 and a pair of oil deflecting partitions 2 is disposed in the oil pan transverse to the elongation of the latter. The oil deflecting partitions 2 are located one above the other and are symmetrical with respect to the central plane 1*d* of the oil pan. The oil deflecting partitions 2 are held by supports 3 which are situated on the inner surfaces of the side walls 1*a*, 1*b* and run longitudinally of the oil pan.

Each of the oil deflecting partitions 2 has two mounting portions 2*a* which are receivable in the supports 3 and serve to carry the respective oil deflecting partition 2. The mounting portions 2*a* may be considered to constitute a means for supporting the oil deflecting partitions on the side walls 1*a*, 1*b*. Each of the oil deflecting partitions 2 further includes an oil deflecting portion 2*b* which functions to deflect oil surging through the oil pan and thus to dampen oil surges.

The mounting portions 2*a* project laterally of the respective oil deflecting portions 2*b*, and the two mounting portions 2*a* of each oil deflecting partition 2 together define a support plane S. Each oil deflecting portion 2*b*, on the other hand, defines two oil deflecting surfaces or planes D which are perpendicular to the support planes S. In FIG. 1, the support planes S are horizontal while the oil deflecting planes D are vertical. Only one oil deflecting plane D of each oil deflecting partition 2 is visible in FIG. 1.

The oil pan has a flask-shaped cross-sectional configuration and includes a neck section as well as an expanded section which bulges outward laterally of the neck section. The expanded section has a location at which the cross section of the expanded section is a maximum and the lower supports 3 are mounted at such location. The upper supports 3 are located in the neck section of the oil pan.

The upper end of the side wall 1*a* is provided with a flange 5*a* and the upper end of the side wall 1*b* is provided with a flange 5*b*. The flanges 5*a* and 5*b* serve to connect the oil pan to a crankcase. The wall thickness of the flanges 5*a*, 5*b* is greater than that of the remaining portions of the side walls 1*a*,1*b*. This makes it possible to insert screws or other fastening elements in the flanges 5*a*, 5*b*.

Figure 3:
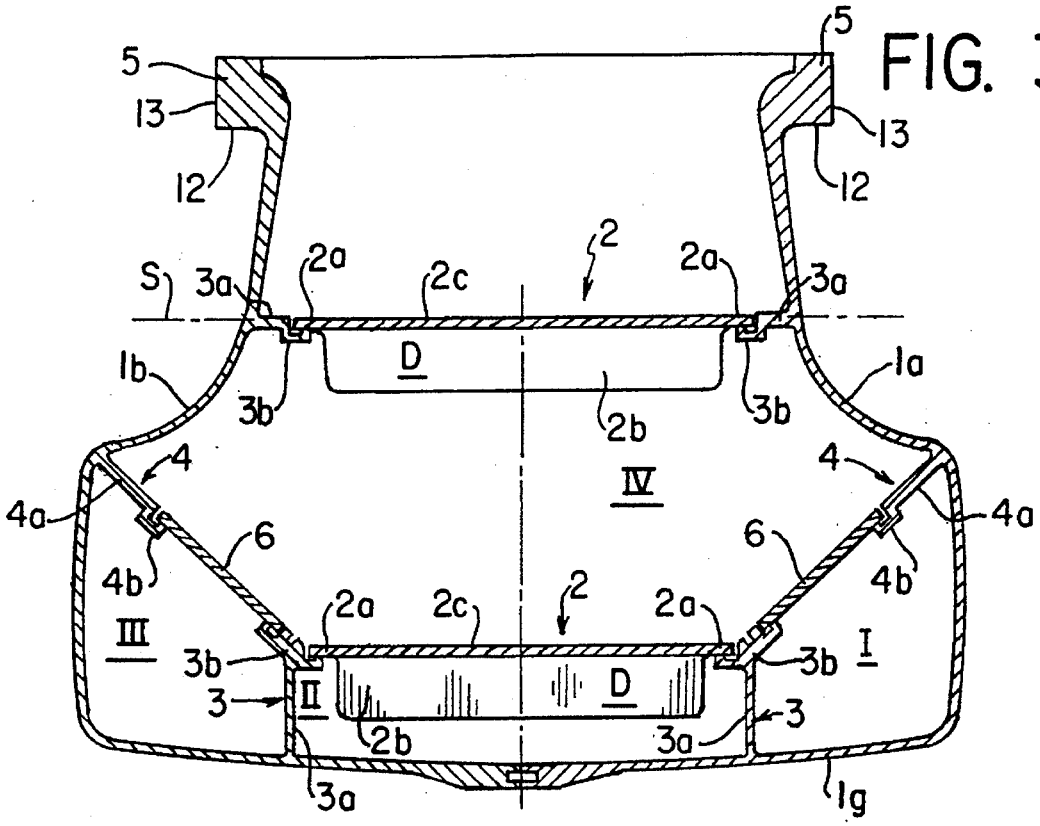
FIG. 3 is a sectional view of the oil pan of FIG. 2*a* as seen in the direction of the arrows III—III of FIG. 2*a;*

FIGS. 2*a*, 2*b* and 3 illustrate an oil pan which again includes side walls 1*a* and 1*b* in the form of extrusions. The oil pan is elongated as seen in FIG. 2*a* and has opposed, open longitudinal ends which are closed by respective covers 1*e* and 1*f*. The covers 1*e* and 1*f* may be considered to constitute end walls of the oil pan.

FIG. 2*b* is an enlarged view of the area A in FIG. 2*a* and shows how the cover 1*f* is mounted on the oil pan. The reference numeral 1*g* identifies the bottom wall of the oil pan, and the cover 1*f* is provided with a cutout 1*h* which allows the cover 1*f* to sit on top, and at the same time overlap the end, of the bottom wall 1*g*. A seal is formed between the cover 1*f* and the bottom wall 1*g*. The cover 1*f* mates with the side walls 1*a* and 1*b* in a similar fashion. The cover 1*e* is mounted on the oil pan in the same manner as the cover 1*f*. The covers 1*e* and 1*f* may be connected to the walls 1*a*, 1*b* and 1*g* conventionally using screws, adhesive or the like.

The oil pan of FIGS. 2*a*, 2*b* and 3 is provided with an upper oil deflecting partition 2 and three lower oil deflecting partitions 2 as illustrated in FIG. 2*a*. These oil deflecting partitions 2 are U-shaped as also seen in FIG. 2*a*, and each has a pair of legs 2*b* as well as a transverse member or bridge 2*c* which connects the respective legs 2*b* to one another. Each of the oil deflecting partitions 2 is further provided with two mounting portions 2*a* which define a support plane S for the associated oil deflecting partition 2. The mounting portions 2*a*, which are integral with the corresponding bridges 2*c* and form part of the latter, project laterally of the respective legs 2*b* in order that they may be readily engaged with the supports 3. The legs 2*b* constitute oil deflecting portions of the oil deflecting partitions 2, and each of the legs 2*b* defines an oil deflecting surface or plane D which is normal to the associated support plane S. FIG. 2*a* illustrates that the U-shaped oil deflecting partitions 2 can be positioned with the legs 2*b* facing either up or down.

In addition to the oil deflecting partitions 2, the oil pan of FIGS. 2*a*, 2*b* and 3 is provided with partitions 6 which are spaced from another in the longitudinal direction of the oil pan. The partitions 6, which may be in the form of sheets or ribs, constitute reinforcements for the oil pan.

Referring to FIG. 3, it will be observed that the oil pan is once again flask-shaped in cross section and has a neck section as well as an expanded section. The supports 3 for the upper oil deflecting partition 2 in FIG. 3 are mounted in the neck section whereas the supports 3 for the lower oil deflecting partitions 2 are disposed in the expanded section on the bottom wall 1*g* of the oil pan.

Each of the reinforcements 6 is carried by one of the lower supports 3 and by an additional support 4 situated in the expanded section. The supports 3 and 4 project from the inner surfaces of the walls 1*a*, 1*b* and 1*g* into the interior of the oil pan and extend longitudinally of the latter from one of the covers 1*e*, 1*f* to the other. It is preferred for the upper supports 3 to be located in the central region of the neck section, for the supports 4 to be located in the central region of the expanded section and for the lower supports 3 to be located in the central region of the bottom wall 1*g*.

The oil pan has a main oil compartment IV which is closed on the sides by the side walls 1*a*, 1*b* and at the ends by the covers 1*e*, 1*f*. From below, the main oil compartment IV is delimited by the supports 4, the lower supports 3, the reinforcements 6 and the lower oil deflecting partitions 2. The main oil compartment IV communicates with three auxiliary compartments I, II and III situated in the bottom part of the oil pan. The auxiliary compartment I is defined by the side wall 1*a*, bottom wall 1*g*, covers 1*e*, 1*f*, right-hand lower support 3, right-hand support 4 and right-hand reinforcement 6; the auxiliary compartment II by the bottom wall 1*g*, covers 1*e*, 1*f*, lower supports 3 and lower oil deflecting partitions 2; and the auxiliary compartment III by the side wall 1*b*, bottom wall 1*g*, covers 1*e*, 1*f*, left-hand lower support 3, left-hand support 4 and left-hand reinforcement 6. The auxiliary compartments I, II and III significantly influence the damping of oil surges which arise during operation of the combustion engine.

Each of the supports 3 comprises a strip-like element or spacer 3*a* and a reinforced holder 3*b* which engages the associated oil deflecting partition 2, or the associated oil deflecting partition 2 and reinforcement 6. The holder 3*b* of a support 3 is mounted on the corresponding spacer 3*a* at the edge thereof remote from the respective wall 1*a*, 1*b* or 1*g*.

Similarly, each of the supports 4 includes a strip-like element or spacer 4*a* and a reinforced holder 4*b* which engages the corresponding reinforcement 6. The holder 4*b* of a support 4 is disposed at the edge of the respective spacer 4*a* which is remote from the associated wall 1*a* or 1*b*.

The holders 3*b* and 4*b* can be fork-shaped, V-shaped or C-shaped. The oil deflecting partitions 2 and their holders 3*b*, as well as the reinforcements 6 and their holders 3*b* and 4*b*, may be provided with complementary coupling portions, i.e., coupling portions which are not rigidly connected to one another. Alternatively or additionally, a rigid connection can be established between the holders 3*b*, 4*b* and the oil deflecting partitions 2 and reinforcements 6.

The oil deflecting partitions 2 and reinforcements 6 can be welded to the respective holders 3*b* and 4*b*. In such an event, the widths of the spacers 3*a* and 4*a* are advantageously such that the walls 1*a*, 1*b* and 1*g* lie outside of the heat affected zones. It is preferred for the widths of the spacers 3*a* and 4*a* to be in the range of 10 to 50 mm. Furthermore, the widths of the spacers 3*a* and 4*a* are favorably selected so that the width of the upper spacers 3*a* is less than the width of the spacers 4*a* which, in turn, is less than the width of the lower spacers 3*a*. It is of particular advantage for the widths of the spacers 3*a*, 4*a* to lie in the ratio 1:2:3.

The supports 3, 4 constitute longitudinally extending ribs of the oil pan. The design of the supports 3, 4 with reinforced holders 3*b*, 4*b* which are spaced from the walls 1*a*, 1*b* and 1*g* by spacers 3*a*, 4*a* has a favorable effect on the oscillation characteristics of the oil deflecting partitions 2, reinforcements 6 and walls 1*a*, 1*b* and 1*g*. Thus, this design results in an uncoupling of the oscillation planes.

Due to the mass-dependent oscillation characteristics of the oil pan, the wall thickness advantageously increases from the bottom wall 1*g* towards the flanges 5*a*, 5*b* where it reaches a maximum. This provides an optimum relationship between weight distribution and resistance to deformation.

The reinforcements 6 may have solid or discontinuous cross sections. Furthermore, the longitudinally spaced reinforcements 6 can be replaced by reinforcements which extend the length of the oil pan. It is also possible to provide additional oil deflecting partitions 2 which bridge the supports 4 and the lower supports 3.

The flanges 5*a*, 5*b* each have a gripping or clamping surface 12 extending longitudinally of the oil pan and a centering surface 13 which is perpendicular to the surface 12. The centering surface 13 functions to center the oil pan in a gripping or clamping device. As indicated earlier, the oil deflecting partitions 2 and reinforcements 6 can be joined to the respective holders 3*b* and 4*b* by welds. Such welds are preferably butt welds which are complementary to the holders 3*b*, 4*b*.

Figure 4A:
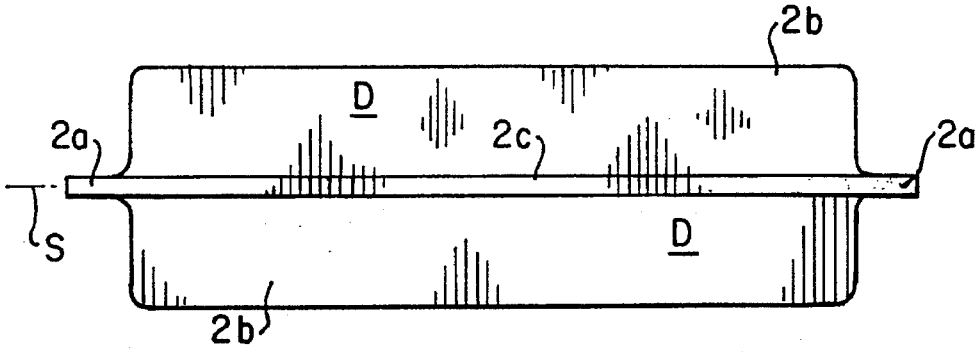
FIG. 4*a* is a side view of another embodiment of an oil pan partition.
Figure 4B:
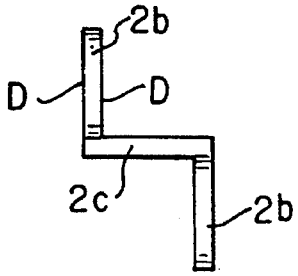
FIG. 4*b* is an end view of the partition of FIG. 4*a*.

FIGS. 4*a* and 4*b* illustrate a Z-shaped oil deflecting partition 2 having a pair of legs 2*b* as well as a transverse member or bridge 2*c* which connects the legs 2*b* to one another. The oil deflecting partition 2 of FIGS. 4*a* and 4*b* again has mounting portions 2*a* which define a support plane S for the oil deflecting partition 2. The mounting portions 2*a*, which are integral with the bridge 2*c* and form part of the latter, project laterally of the legs 2*b* so that they may be readily engaged with the supports 3. The legs 2*b* constitute oil deflecting portions of the oil deflecting partitions 2, and each of the legs 2*b* defines two oil deflecting surfaces or planes D which are normal to the support plane S.

To make an oil pan in accordance with the invention, appropriately shaped extrusions are placed adjacent one another so that they define an oil chamber having a bottom. The extrusions have adjoining areas at the oil chamber bottom, and these areas are connected to one another by thermal means, e.g., welding. Partitions are then inserted in the oil chamber and mounted on the inner surfaces thereof, preferably at a spacing from the inner surfaces, thermally and/or mechanically.

Various modifications are possible within the meaning and range of equivalence of the appended claims.

I claim:

1. An oil pan for combustion machines, comprising wall means defining an oil chamber; and partitioning means in said chamber including a first partition having first means for supporting said partition on said wall means and second means for deflecting oil in said chamber, said first means defining a support plane for said partition, and said second means defining at least one oil deflecting plane which is substantially normal to said support plane, said partitioning means further including a second partition similar to said first partition, and said partitions being arranged one above the other.

2. The oil pan of claim 1, wherein said support plane is arranged to be substantially horizontal.

3. The oil pan of claim 1, wherein said chamber has opposed ends and said wall means comprises a plurality of extrusions defining first walls of said chamber and extending between said ends, said wall means further comprising a cover at each of said ends, and said covers being secured to said extrusions and defining second walls of said chamber.

4. The oil pan of claim 3, wherein said wall means comprises a flange for connection to a crankcase.

5. The oil pan of claim 1, wherein said chamber is elongated and said first partition extends transversely of said chamber.

6. The oil pan of claim 1, wherein said first partition includes a pair of legs and a bridge between said legs, said first means constituting part of said bridge and said second means being at least partly constituted by said legs.

7. The oil pan of claim 6, wherein said first partition is substantially U-shaped.

8. The oil pan of claim 6, wherein said first partition is substantially Z-shaped.

9. The oil pan of claim 1, wherein said chamber is elongated and said wall means is provided with support means for said first partition, said support means extending longitudinally of said chamber.

10. The oil pan of claim 1, wherein said first means projects laterally of said second means.

11. The oil pan of claim 1, wherein said wall means is provided with support means for said first partition, said first means and said support means having rigidly connected portions.

12. The oil pan of claim 1, wherein said partitioning means comprises an additional partition which is mounted on and constitutes a reinforcement for, said wall means.

13. The oil pan of claim 12, wherein said wall means is provided with support means for said partitions, said wall means, support means and partitions cooperating to divide said chamber into a main oil compartment and a plurality of auxiliary compartments.

14. The oil pan of claim 13, wherein said auxiliary compartments are in communication with said main compartment.

15. The oil pan of claim 1, wherein said wall means is provided with support means for said first partition, said first means and said support means having complementary coupling portions.

16. An oil pan for combustion machines, comprising wall means defining an elongated oil chamber; and partitioning means in said chamber including at least one partition having first means for supporting said partition on said wall means and second means for deflecting oil in said chamber, said first means defining a support plane for said partition, and said second means defining at least one oil deflecting plane which is substantially normal to said support plane, said wall means being provided with support means for said partition, and said support means extending longitudinally of said chamber, said support means comprising a strip-like portion which projects from said wall means and a holding portion for said partition mounted on said strip-like portion at a spacing from said wall means.

17. The oil pan of claim 16, wherein said holding portion is spaced from said wall means by a distance of about 10 mm to about 50 mm.

18. The oil pan of claim 16, wherein said holding portion is substantially C-shaped.

19. The oil pan of claim 16, wherein said holding portion is substantially fork-shaped.

20. The oil pan of claim 16, wherein said holding portion is substantially V-shaped.

21. An oil pan for combustion machines, comprising wall means defining an oil chamber; and partitioning means in said chamber including at least one partition having first means for supporting said partition on said wall means and second means for deflecting oil in said chamber, said first means defining a support plane for said partition, and said second means defining at least one oil deflecting plane which is substantially normal to said support plane, said wall means being provided with support means for said partition, and said partition being connected to said support means by a weld.

22. The oil pan of claim 21, wherein said weld and said support means have complementary coupling portions.

23. The oil pan of claim 21, wherein said weld is a butt weld.

24. An oil pan for combustion machines, comprising wall means defining an oil chamber; and partitioning means in said chamber including a first partition having first means for supporting said partition on said wall means and second means for deflecting oil in said chamber, said first means defining a support plane for said partition, and said second means defining at least one oil deflecting plane which is substantially normal to said support plane, said partitioning means further including a second partition, and said wall means being provided with first support means for said first partition and second support means for said second partition, said wall means including a neck section and an outwardly bulging section having a location of maximum cross section, one of said support means being disposed in said neck section and the other of said support means being disposed at said location.

25. An oil pan for combustion machines, comprising wall means defining an oil chamber; and partitioning means in said chamber including a first partition having first means for supporting said partition on said wall means and second means for deflecting oil in said chamber, said first means defining a support plane for said partition, and said second means defining at least one oil deflecting plane which is substantially normal to said support plane, said partitioning means further including at least two additional partitions, and said wall means being provided with first, second and third support means for said partitions, said wall means including a neck section, an outwardly bulging section and a bottom, and said first, second and third support means being disposed in said neck section, in said bulging section and on said bottom, respectively, each of said support means comprising a strip-like portion which projects, and has an edge remote, from said wall means, and each of said support means further comprising a holding portion mounted on the edge of the corresponding strip-like portion, the width of the strip-like portion of said second support means exceeding the width of the strip-like portion of said first support means, and the width of the strip-like portion of said third support means exceeding the width of the strip-like portion of said second support means.

26. The oil pan of claim 25, wherein the ratio of said widths is about 1:2:3.

27. An oil pan for combustion machines, comprising wall means defining an oil chamber; and partitioning means in said chamber including at least one partition having first means for supporting said partition on said wall means and second means for deflecting oil in said chamber, said first means defining a support plane for said partition, and said second means defining at least one oil deflecting plane which is substantially normal to said support plane, said wall means being provided with support means for said partition, and said support means including a strip-like portion which projects, and has an edge remote, from said wall means, said partition being connected to said support means by a weld in the region of said edge, and the width of said strip-like portion being such that said wall means is outside the heat-affected zone of said weld.

28. An oil pan for combustion machines, comprising wall means defining an elongated oil chamber, said wall means including flange means for connection to a crankcase, and said flange means having a thickness greater than that of the remainder of said wall means, said flange means being provided with a mounting surface and a centering surface for positioning said wall means in a gripping device, and said mounting surface extending longitudinally of said chamber; and partitioning means in said chamber including at least one partition having first means for supporting said partition on said wall means and second means for deflecting oil in said chamber, said first means defining a support plane for said partition, and said second means defining at least one oil deflecting plane which is substantially normal to said support plane.

* * * * *